US009878879B2

(12) United States Patent
Kim

(10) Patent No.: US 9,878,879 B2
(45) Date of Patent: Jan. 30, 2018

(54) SUPERSIZED ELEVATOR FOR USE IN BUILDING LARGE SHIP OR OFFSHORE PLANT

(71) Applicant: Songsan Special Elevators Co., Ltd., Gyeonggi-do (KR)

(72) Inventor: Gi-Young Kim, Gyeonggi-do (KR)

(73) Assignee: SONGSAN SPECIAL ELEVATORS CO., LTD., Gyeonggi-do (KR)

( * ) Notice: Subject to any disclaimer, the term of this patent is extended or adjusted under 35 U.S.C. 154(b) by 232 days.

(21) Appl. No.: 14/995,549

(22) Filed: Jan. 14, 2016

(65) Prior Publication Data

US 2017/0107081 A1 Apr. 20, 2017

(30) Foreign Application Priority Data

Oct. 20, 2015 (KR) ..... 10-2015-0145941

(51) Int. Cl.
*B66B 9/187* (2006.01)
*B66B 5/16* (2006.01)
*B66B 5/22* (2006.01)

(52) U.S. Cl.
CPC ..... *B66B 9/187* (2013.01); *B66B 5/16* (2013.01); *B66B 5/22* (2013.01)

(58) Field of Classification Search
CPC ..... B66B 9/187; B66B 5/16; B66B 5/22
See application file for complete search history.

(56) References Cited

U.S. PATENT DOCUMENTS 485,163 A * 11/1892 Bassett ..... B66B 11/009 187/260
719,852 A * 2/1903 Ortner ..... B66B 7/022 187/407
3,241,634 A * 3/1966 Prosser ..... B66B 9/187 182/128
3,882,968 A * 5/1975 Suozzo ..... B66B 7/068 187/264
5,861,084 A * 1/1999 Barker ..... B66B 7/06 187/264
6,182,791 B1 * 2/2001 Cope ..... B66B 9/187 182/141
6,488,125 B1 * 12/2002 Otsuka ..... B66B 7/068 187/254
7,117,978 B2 * 10/2006 Kaczmarek ..... B66B 7/068 187/251

(Continued)

FOREIGN PATENT DOCUMENTS

JP 2006160448 A * 6/2006

*Primary Examiner* — Michael A Riegelman
(74) *Attorney, Agent, or Firm* — IP & T Group LLP

(57) ABSTRACT

A supersized elevator for use in building a large ship or an offshore plant is provided. The supersized elevator includes an elevator structure (100), an elevator cage (200) configured to accommodate passengers and heavy articles, a counterweight (230) configured to maintain a weight balance with the elevator cage (200), a wire rope (220) configured to interconnect the elevator cage (200) and the counterweight (230), and a winding machine (210) configured to wind the wire rope (220). A wind shield module (800) configured to prevent a tail cable (910) from being affected by a strong wind is vertically installed on one inner side surface of the elevator structure (100).

9 Claims, 13 Drawing Sheets

(56) References Cited

U.S. PATENT DOCUMENTS

| | | | | |
|---|---|---|---|---|
| 7,762,378 | B2 * | 7/2010 | Mori | B66B 7/068<br>184/21 |
| 2004/0020717 | A1 * | 2/2004 | Robillard | B66B 9/187<br>182/141 |
| 2004/0055831 | A1 * | 3/2004 | Huber | B66B 7/068<br>187/412 |
| 2010/0243382 | A1 * | 9/2010 | Sterner | B65H 75/362<br>187/413 |
| 2013/0020150 | A1 * | 1/2013 | Ropponen | B66B 7/06<br>187/414 |
| 2014/0110194 | A1 * | 4/2014 | Zhu | B66B 7/08<br>187/254 |

* cited by examiner

[Fig. 1] (Prior Art)
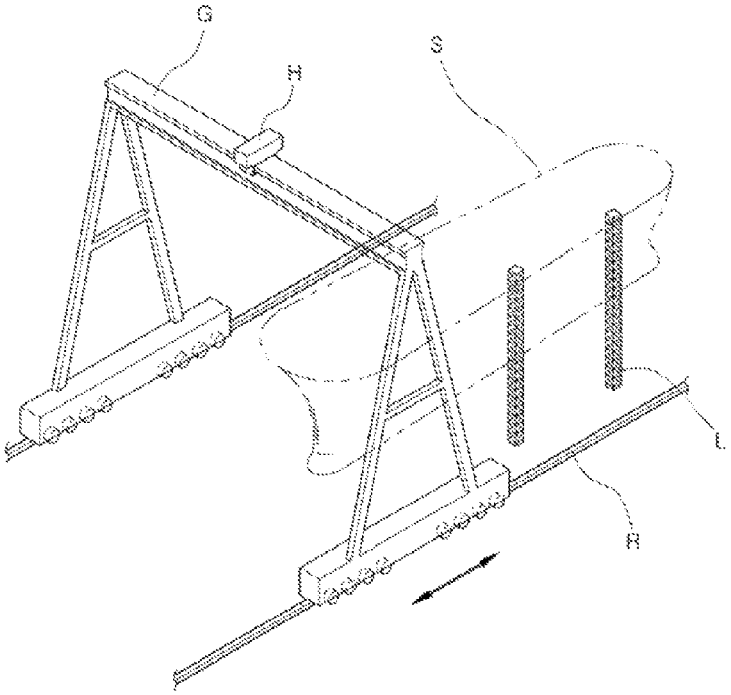
[Fig. 2]
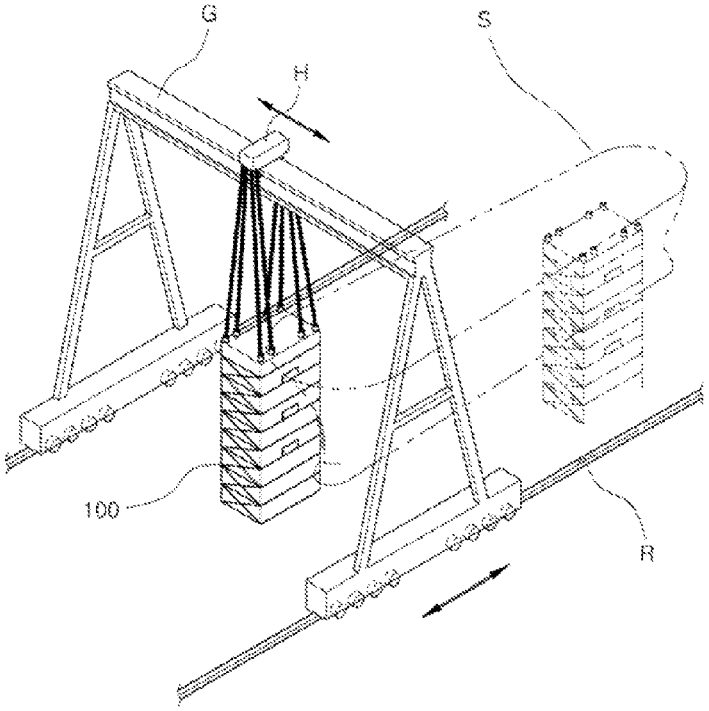

[Fig. 3]
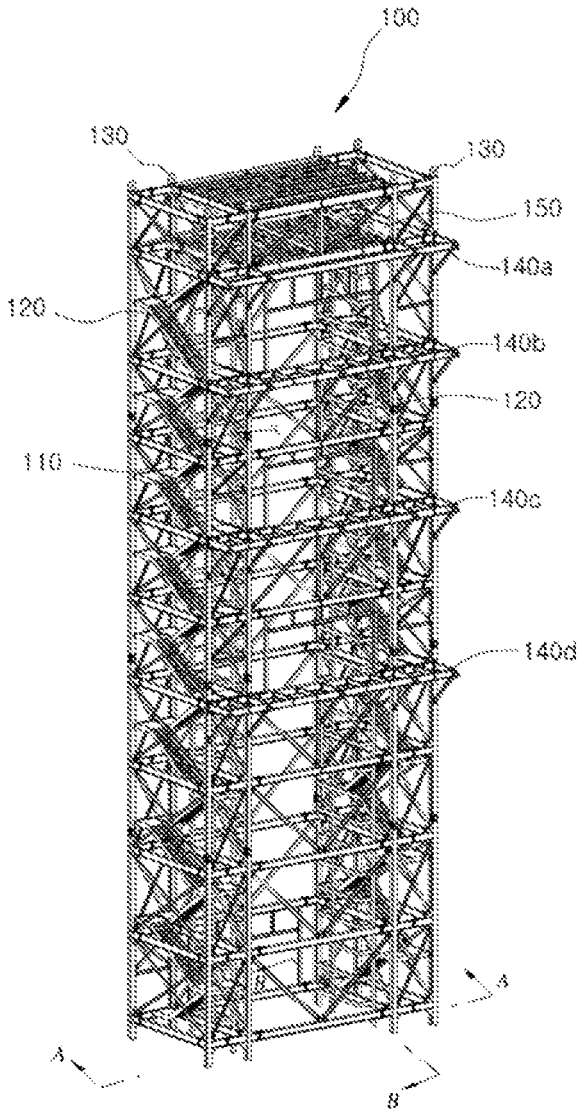

[Fig. 4]
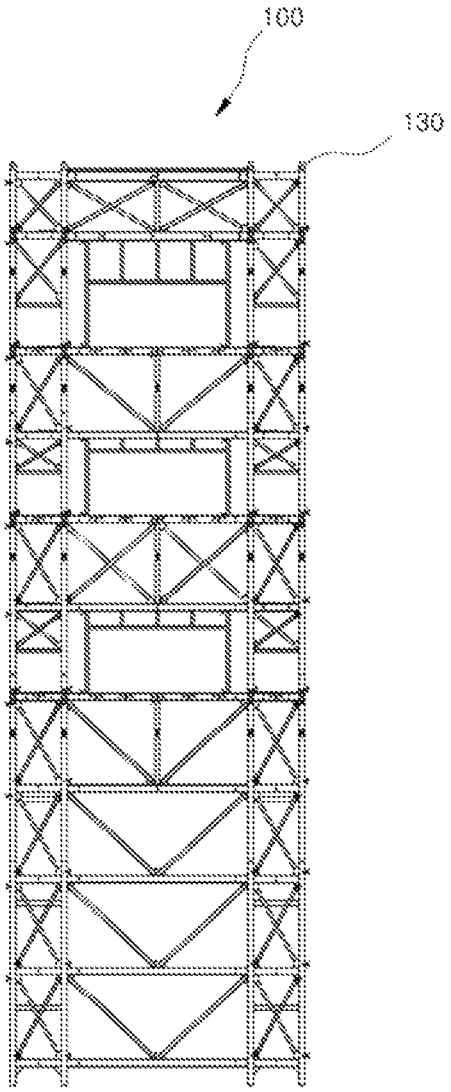

[Fig. 5]
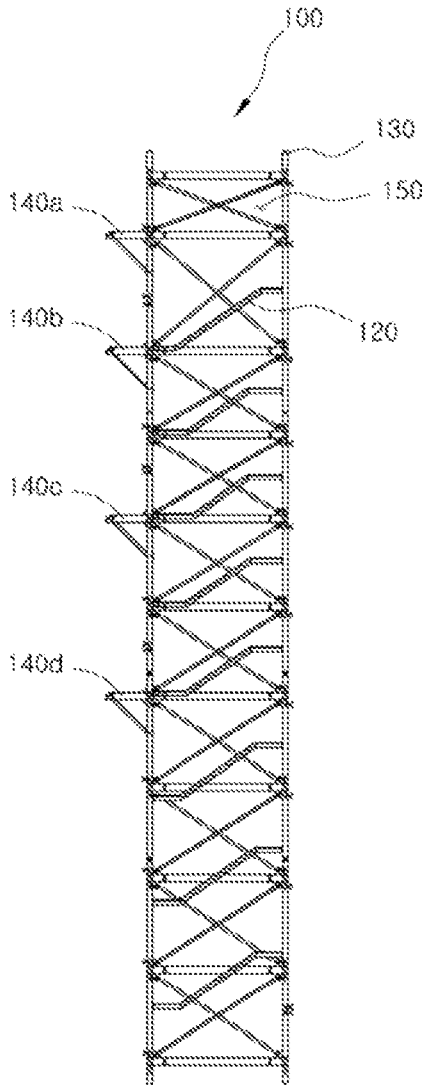

[Fig. 6]
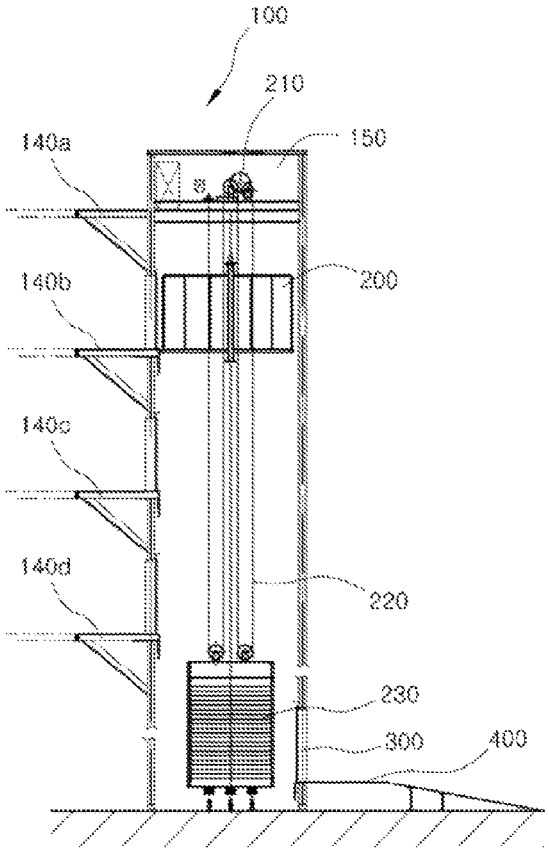
[Fig. 7]
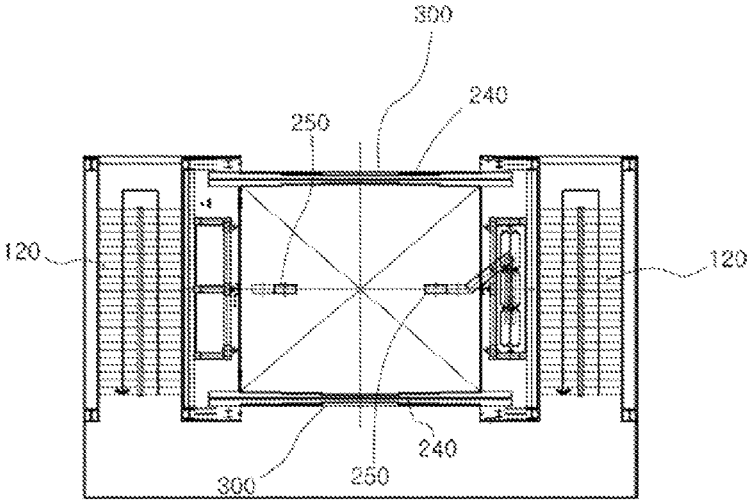

[Fig. 8]
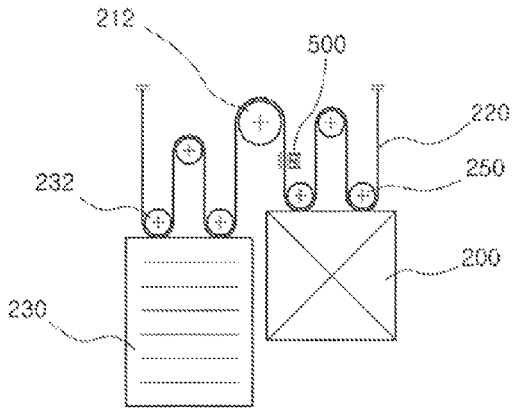
[Fig. 9]
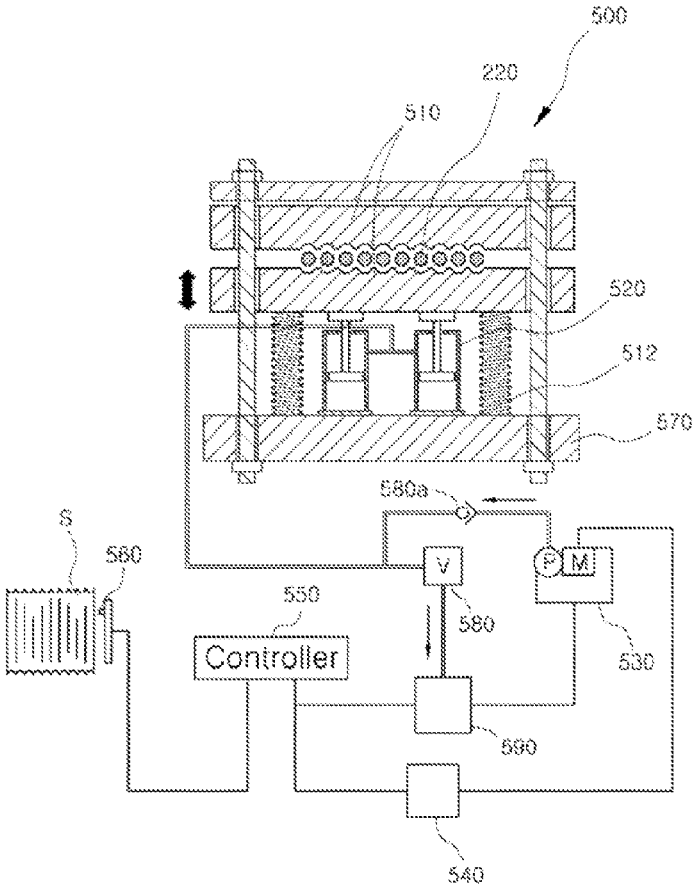

[Fig. 10]
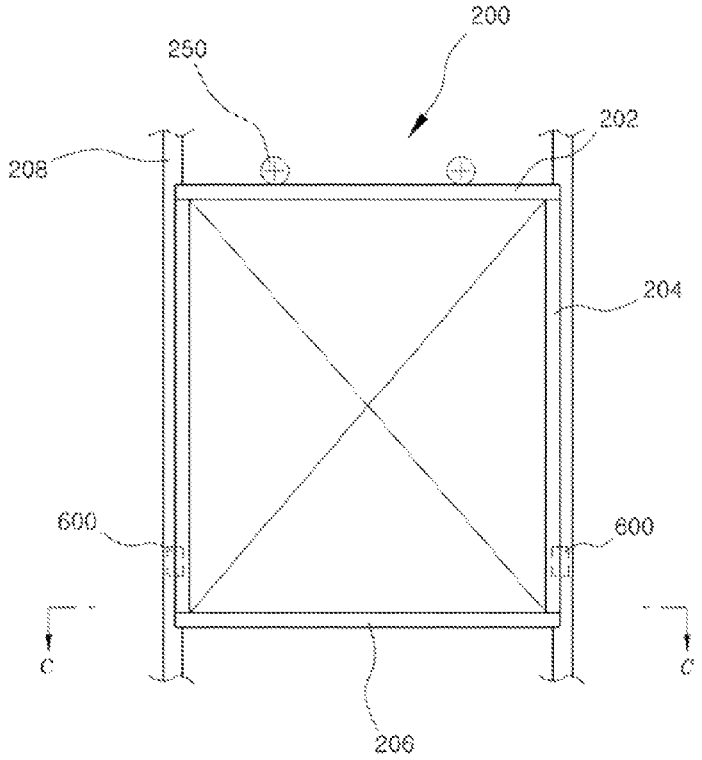
[Fig. 11]
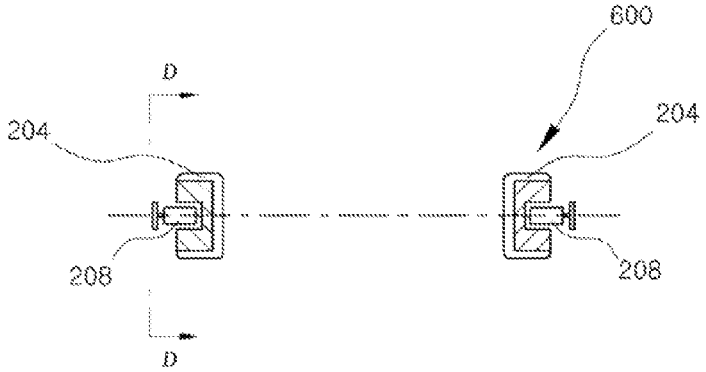

[Fig. 12]
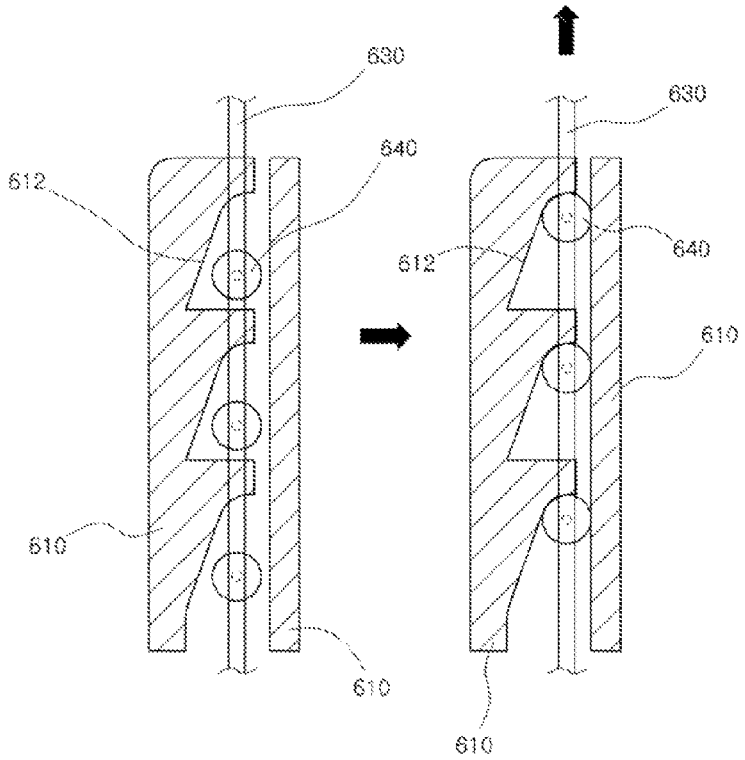
[Fig. 13]
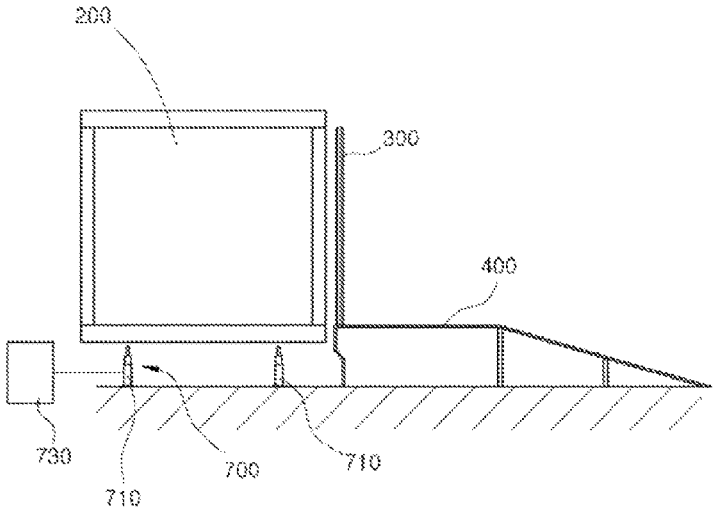

[Fig. 14]
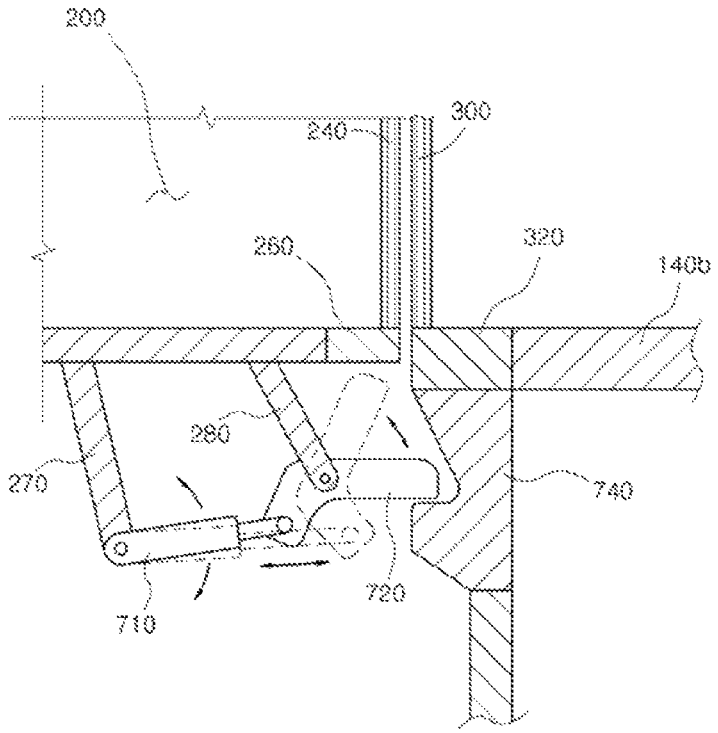
[Fig. 15]
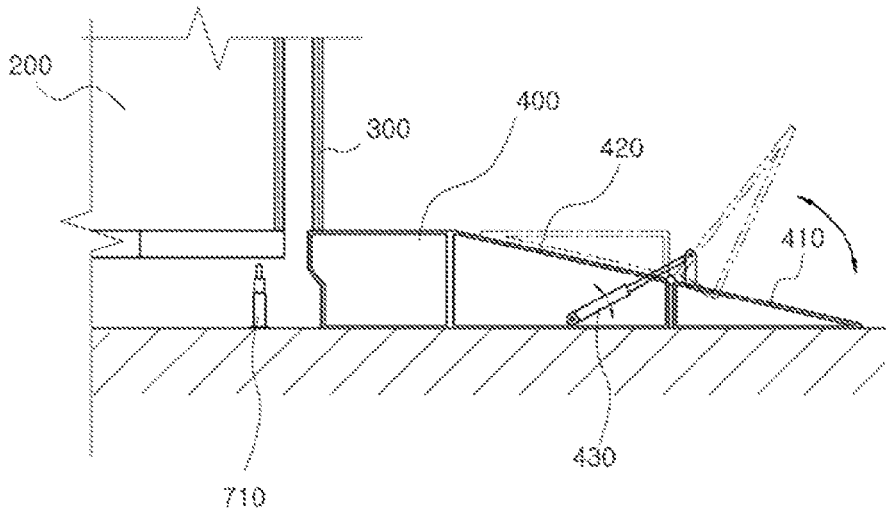

[Fig. 16]
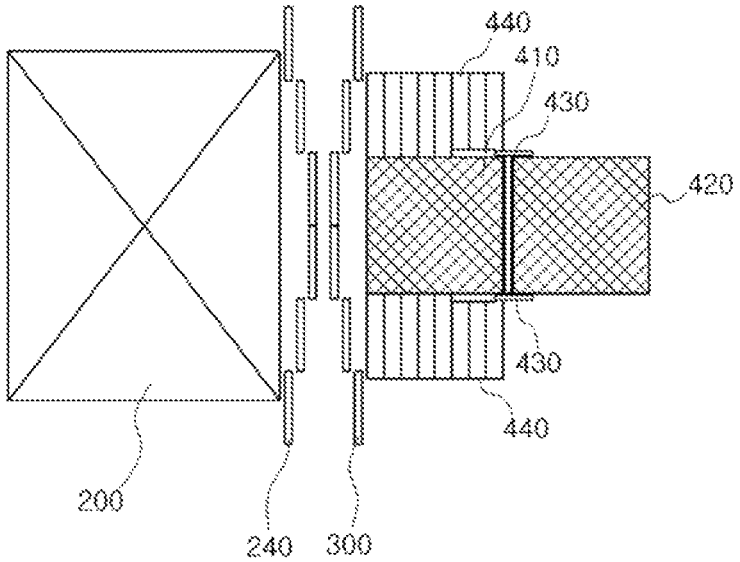
[Fig. 17]
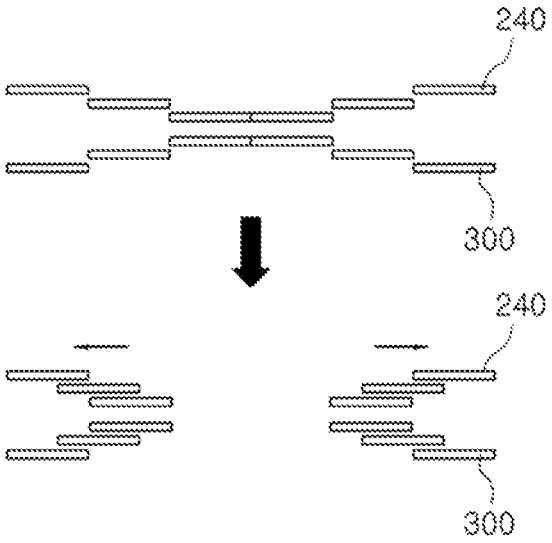

[Fig. 18]
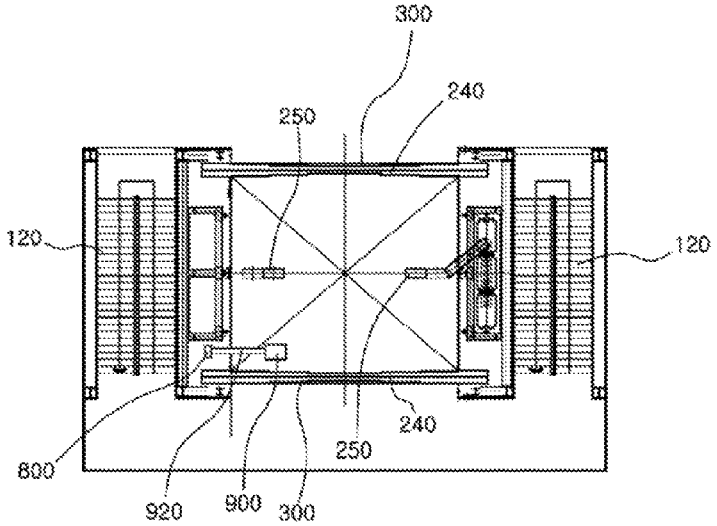
[Fig. 19]
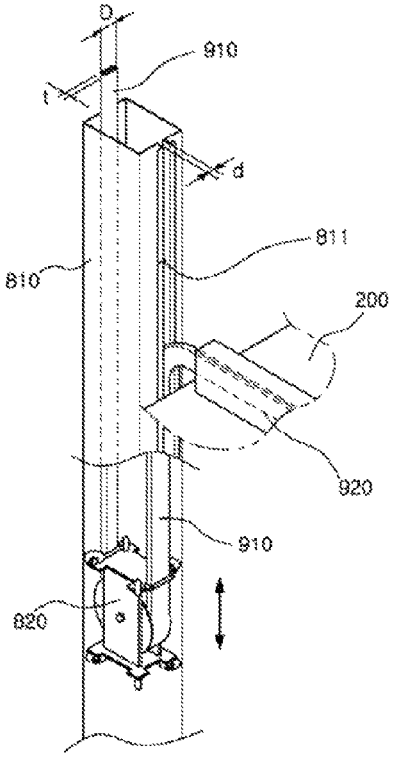

[Fig. 20]
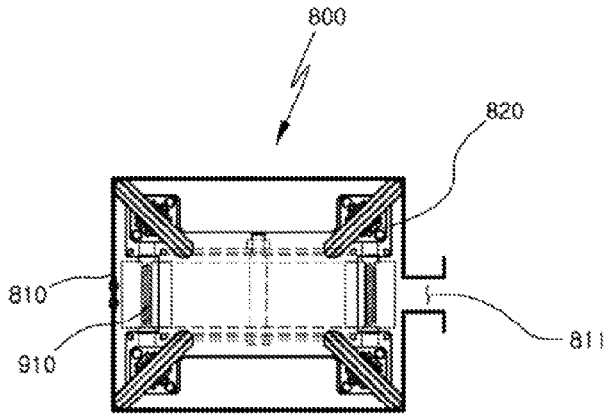
[Fig. 21]
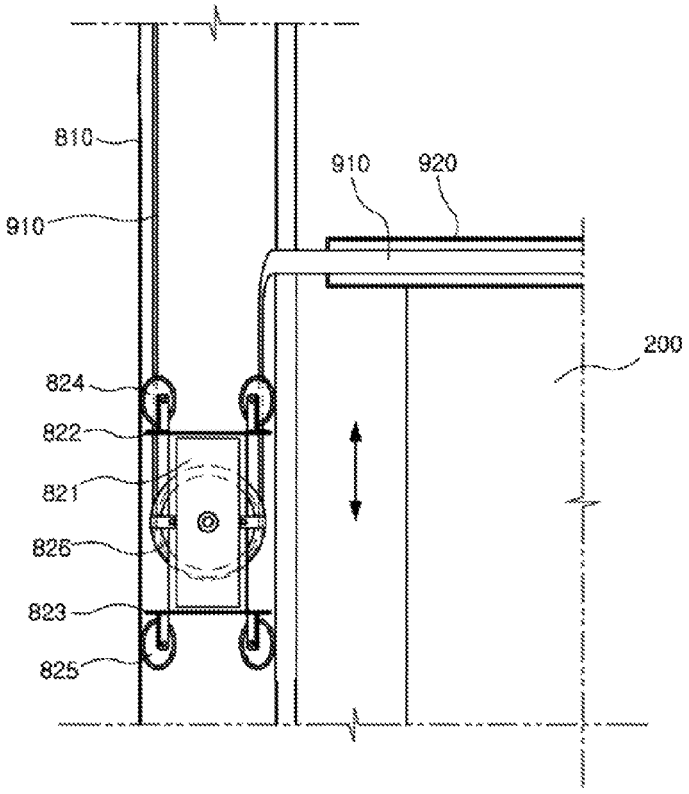

[Fig. 22]
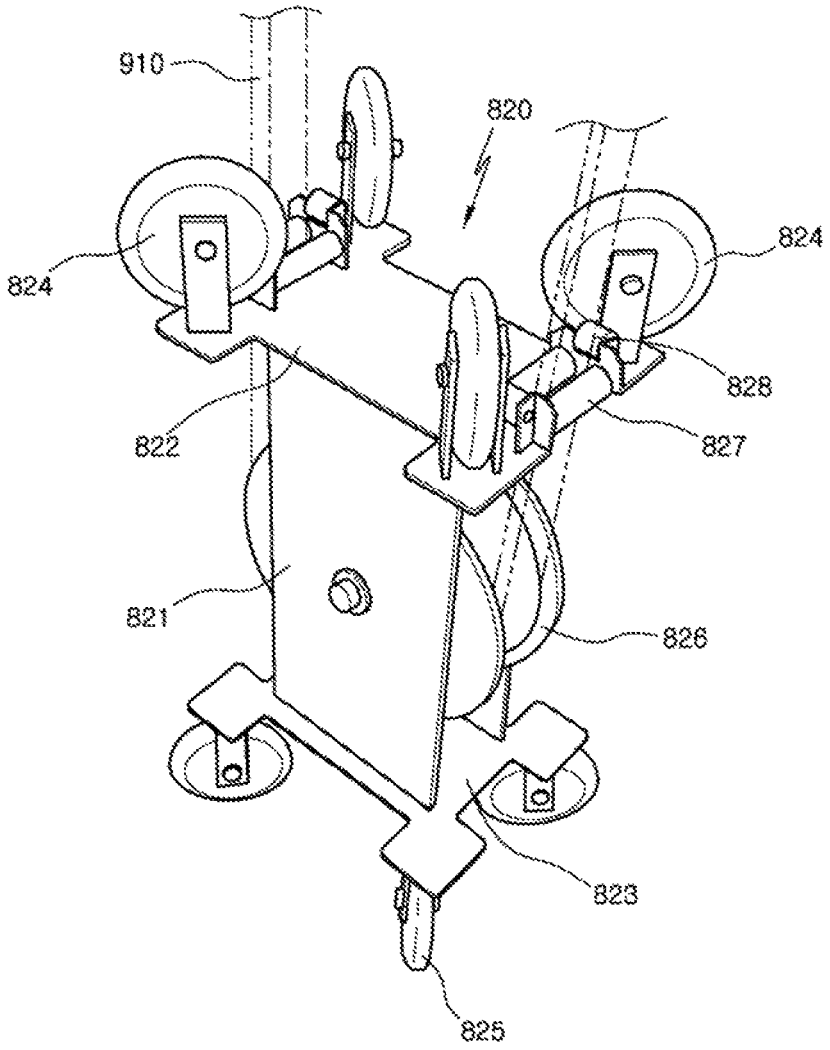

SUPERSIZED ELEVATOR FOR USE IN BUILDING LARGE SHIP OR OFFSHORE PLANT

CROSS-REFERENCE TO RELATED APPLICATIONS

The present application claims priority to Korean patent application number 10-2015-0145941, filed on Oct. 20, 2015, the entire disclosure of which is herein incorporated by reference in its entirety.

FIELD OF THE INVENTION

The present invention relates to a supersized elevator for use in building a large ship or an offshore plant, which is provided with a cable wind shield module. More particularly, the present invention pertains to a supersized elevator for use in building a large ship or an offshore plant, which is capable of rapidly and simultaneously deploying a multiple number of workers to a work site when building a large ship and an offshore plant in a dock of a shipyard, capable of shortening a work preparation time and consequently improving productivity, capable of rapidly moving a multiple number of workers working in a high work site to the ground upon generation of an emergency situation such as a fire or a safety accident, capable of quickly transporting various kinds of materials and work vehicles such as a forklift truck or the like to a high place, capable of enabling a crane to easily transport a consolidated structure including an elevator cage, emergency stairs and a machine room, and capable of enabling a cable wind shield module to prevent a strong wind from affecting a tail cable which is moved up and down together with an elevator cage.

BACKGROUND ART

In the case of building a ship or an offshore plant structure such as a drillship or the like in a shipyard, works are performed in a dock provided with a gantry crane or a medium/large crane.

FIG. 1 schematically shows a case where a supersized ship is built using a gantry crane G. The gantry crane G (usually called a "Goliath crane" in a work site) consists of a pair of vertical beams and a horizontal beam, and moves along rails R installed on the ground.

On the other hand, the medium/large crane has a rotatable boom. The medium/large crane is of a post type or is configured to move along rails R installed on the ground.

The gantry crane G or the medium/large crane lifts up a component manufactured in a component manufacturing factory and then transports the component to a necessary place where a ship or an offshore plant is built.

When building a supersized ship or an offshore plant having a weight of hundreds of thousands tons, it is necessary to simultaneously input several hundreds of workers or several thousands of workers to a work site.

For this purpose, as illustrated in FIG. 1, a lift L or stairs (not shown) for transporting workers to a work place is additionally installed on a lateral side of a ship S to be built.

However, the lift L of the related art illustrated in FIG. 1 is not capable of simultaneously transporting a large number of workers to a high work site. Since the lift L illustrated in FIG. 1 is a small-sized lift typically installed in a construction spot, only several workers can get on the lift L at one time.

Thus, a great deal of time is required in deploying several hundreds of workers or several thousands of workers to a high work site. As a result, the actual work time is reduced and the productivity is deteriorated.

In the case where workers move up and down through stairs, there is a high risk that a slip accident occurs when rain or snow falls.

Furthermore, in the case of using the lift or the stairs, a great deal of time is wasted during the commuting time or before and after the lunch time.

In reality, it is sometimes the case that, when building a large ship, more than one hour is required in completely deploying workers to a high work site.

In order to solve the problems noted above, it may be thinkable to install a plurality of lifts L. In this case, the lift installation cost increases. Moreover, the problems cannot be completely solved by merely installing additional lifts.

Furthermore, the lift transportation method of the related art is not capable of appropriately coping with a situation that there is a need to rapidly evacuate a large number of workers to the ground in the case of occurrence of a fire or a safety accident. Thus, if a fire or an explosion accident occurs in a building site of a large ship or an offshore plant, this may lead to big tragedy.

In addition, the lift of the related art is designed to merely transport workers and is not capable of transporting heavy materials or work vehicles such as a forklift truck and the like.

If the weight of a material exceeds the load capacity of a lift (e.g., about 1 ton), it is necessary to lift up the material using a crane. In this case, there is a need to employ a ground worker, a crane driver and a sky worker.

Under a windy or bad weather condition, it is difficult to perform a lift work using a crane. In the case of performing a lift work using a crane, the lift work is time-consuming and the risk of a safety accident is high.

Typically, a crane used in a shipyard has a height of several tens meters. It is therefore difficult for a crane driver to visually grasp a ground situation. Thus, the crane driver has to operate the crane while communicating with a ground worker using a walkie-talkie. In this process, there is a high risk of occurrence of an accident.

Moreover, the lift L of the related art is installed in the sky and, therefore, has a high risk of occurrence of a safety accident. The lift L is classified into a dangerous machine under the industrial safety regulations which prescribe that a safety guard shall get on a lift to operate the lift in a construction site.

SUMMARY OF THE INVENTION

In view of the above-noted problems, it is an object of the present invention to provide a supersized elevator for use in building a large ship or an offshore plant, which is capable of rapidly and safely deploying a large number of workers and a large amount of materials to a high work site when building a large ship or an offshore plant.

Another object of the present invention is to provide a supersized elevator for use in building a large ship or an offshore plant, which is capable of reducing a waste time and improving productivity by simultaneously and rapidly deploying a large number of workers to a high work site.

A further object of the present invention is to provide a supersized elevator for use in building a large ship or an offshore plant, which is capable of rapidly moving a large number of workers from a high work site to the ground via the supersized elevator and emergency stairs when an emergency situation such as a fire or a safety accident occurs.

A further object of the present invention is to provide a supersized elevator for use in building a large ship or an offshore plant, which is capable of ensuring that a tail cable moving up and down together with an elevator cage is hardly affected by a strong wind of 30 to 50 m/sec.

A further object of the present invention is to provide a supersized elevator for use in building a large ship or an offshore plant, which is capable of rapidly transporting various kinds of heavy articles and work vehicles such as a forklift truck and the like to a high place without having to use a crane.

A further object of the present invention is to provide a supersized elevator for use in building a large ship or an offshore plant, which is capable of being manufactured as a consolidated self-standing structure together with emergency stairs, a machine room and other structures and capable of being easily lifted, moved and provided for continuous use.

A further object of the present invention is to provide a supersized elevator for use in building a large ship or an offshore plant, which is capable of being prevented from crash, overspeed movement and reverse rotation by a wire rope emergency brake device and an elevator cage rail brake device.

A further object of the present invention is to provide a supersized elevator for use in building a large ship or an offshore plant, which is capable of preventing an elevator cage from being sagged even when a heavy article or a forklift truck is loaded into the supersized elevator.

A further object of the present invention is to provide a supersized elevator for use in building a large ship or an offshore plant, which is capable of enabling a work vehicle such as a forklift truck or the like to be easily loaded into an elevator cage.

A further object of the present invention is to provide a supersized elevator for use in building a large ship or an offshore plant, which is capable of minimizing a weight increase and a wind pressure influence by manufacturing all structures other than a machine room in an exposed form with no outer shell.

A further object of the present invention is to provide a supersized elevator for use in building a large ship or an offshore plant, which is capable of being manufactured in an all-weather waterproof form so that the supersized elevator is not affected by rain or snow.

A further object of the present invention is to provide a supersized elevator for use in building a large ship or an offshore plant, which is capable of being easily connected to a ship or an offshore plant.

A further object of the present invention is to provide a supersized elevator for use in building a large ship or an offshore plant, which is capable of essentially preventing occurrence of a safety accident which may otherwise be caused by the use of a lift and the use of stairs.

In order to achieve the above objects, there is provided a supersized elevator for use in building a large ship or an offshore plant, including:

an elevator structure;

an elevator cage configured to accommodate passengers and heavy articles;

a counterweight configured to maintain a weight balance with the elevator cage;

a wire rope configured to interconnect the elevator cage (200) and the counterweight; and a winding machine configured to wind the wire rope, wherein the elevator cage and the counterweight are installed in an elevator installation part provided in a central region of the elevator structure, an emergency stair part is provided at least one side of the elevator installation part, a plurality of hoisting lugs is provided in a top portion of the elevator structure so that the elevator structure as a whole can be hoisted, transported and placed on a flat ground surface, a wind shield module configured to prevent a tail cable from being affected by a strong wind is vertically installed on one inner side surface of the elevator structure, and the wind shield module includes a cover body vertically installed on one side surface of the elevator structure, an elevating body provided inside the cover body so as to move up and down together with the tail cable, and a horizontal guide member provided on a top surface of the elevator cage so as to guide the tail cable which moves up and down together with the elevating body.

In the supersized elevator, the elevating body may include a pair of vertical plates provided in a central region of the elevating body in a spaced-apart relationship with each other, a sheave provided between the vertical plates so that the tail cable is wound around the sheave, an upper plate horizontally provided in top portions of the vertical plates, a plurality of upper wheels provided at corners of the upper plate, a lower plate horizontally provided in bottom portions of the vertical plates, and a plurality of lower wheels provided at corners of the lower plate.

In the supersized elevator, the upper wheels may be provided at four corners of the upper plate and the lower wheels may be provided at four corners of the lower plate.

In the supersized elevator, the upper wheels and the lower wheels may be disposed on diagonal planes so as to move up and down along four corners of the cover body.

In the supersized elevator, two pairs of guide rollers configured to guide the tail cable may be provided on opposite side surfaces of the upper plate of the elevating body.

In the supersized elevator, a pair of auxiliary rollers may be further provided at longitudinal opposite ends of each pair of the guide rollers.

In the supersized elevator, a vertical groove for allowing the tail cable to extend out of the cover body and to move up and down may be formed on one side surface of the cover body.

In the supersized elevator, the vertical groove may have an opening width which is smaller than the width of the tail cable and larger than the thickness of the tail cable.

In the supersized elevator, a horizontal guide member for guiding the tail cable from the vertical groove toward a junction box may be provided in a top portion of the elevator cage.

In the supersized elevator, connection footboards for connecting the elevator structure to the large ship or the offshore plant may be provided on one surface of the elevator structure.

The supersized elevator may further include: a rope emergency brake device configured to prevent crash, overspeed movement and reverse rotation of the elevator cage. The rope emergency brake device may include a brake block module composed of a movable brake block and a fixed brake block and configured to apply brake to a plurality of wire ropes, compression springs and hydraulic cylinders configured to operate the movable brake block of the brake block module, a frame configured to support the brake block module, the compression springs and the hydraulic cylinders, a hydraulic device configured to supply drive power to the hydraulic cylinders, a plurality of sensors installed on one side surface of a wire rope sheave and configured to detect overspeed movement and reverse rotation of the wire rope sheave, a pressure releasing valve configured to, when operated, release a pressure applied to the hydraulic cylinders, and a controller configured to operate the pressure releasing valve when the overspeed movement or the reverse rotation of the wire rope sheave is detected by the sensors.

The supersized elevator may further include: a rechargeable battery used to operate the rope emergency brake device under a power outage condition.

The supersized elevator may further include: a double crash preventing device configured to prevent crash of the elevator cage and provided on a guide rail which guides a side surface of the elevator cage.

In the supersized elevator, the double crash preventing device may include a safety block configured to surround the guide rail and provided with a plurality of slant surfaces formed on one inner side surface thereof, a plurality of roller stoppers provided on the slant surfaces, and a tripping rod connected to the roller stoppers and configured to pull the roller stoppers upward to stop the elevator cage when the elevator cage moves down at an excessive speed.

In the supersized elevator, each of the slant surfaces of the safety block may be formed so as to define a gap which grows smaller toward an upper side.

The supersized elevator may further include: a boarding platform provided on one side surface of the elevator structure and spaced apart by a predetermined distance from a ground surface; and a boarding door installed at one end of the boarding platform.

The supersized elevator may further include: hydraulic cylinders configured to prevent sagging of the elevator cage moved to a lowermost position, the hydraulic cylinders provided on a ground surface which faces toward a lower surface of the elevator cage.

In the supersized elevator, a locking block configured to support a lower portion of the elevator cage stopped in a specific position may be provided under each of the connection footboards, and a support arm configured to engage with the locking block and a hydraulic cylinder configured to rotate the support arm at a predetermined angle may be provided under the elevator cage.

In the supersized elevator, the boarding platform may include an upper slant plate, a lower slant plate and a pair of stairs provided at opposite lateral sides of the upper slant plate.

In the supersized elevator, hydraulic cylinders configured to fold and unfold the lower slant plate may be installed at the opposite lateral sides of the upper slant plate.

In the supersized elevator, the elevator cage may include a plurality of cage doors configured to be partially or fully opened.

In the supersized elevator, a sensor configured to detect workers or work vehicles may be provided to ensure that, when only workers are detected by the sensor, the cage doors are partially opened.

According to the present invention, it is possible to provide a supersized elevator capable of rapidly and safely deploying a large number of workers and a large amount of materials to a high work site when building a large ship or an offshore plant.

Furthermore, it is possible to provide a supersized elevator capable of reducing a waste time and improving productivity by simultaneously and rapidly deploying a large number of workers to a high work site.

Furthermore, it is possible to provide a supersized elevator capable of rapidly moving a large number of workers from a high work site to the ground via the supersized elevator and emergency stairs when an emergency situation such as a fire or a safety accident occurs.

Furthermore, it is possible to provide a supersized elevator capable of ensuring that a tail cable moving up and down together with an elevator cage is hardly affected by a strong wind.

Furthermore, it is possible to provide a supersized elevator capable of rapidly transporting various kinds of heavy articles and work vehicles such as a forklift truck and the like to a high place without having to use a crane.

Furthermore, it is possible to provide a supersized elevator capable of being manufactured as a consolidated self-standing structure together with emergency stairs, a machine room and other structures and capable of being easily lifted, moved and provided for continuous use.

Furthermore, it is possible to provide a supersized elevator capable of being prevented from crash, overspeed movement and reverse rotation by a wire rope emergency brake device and an elevator cage rail brake device.

Furthermore, it is possible to provide a supersized elevator capable of preventing an elevator cage from being sagged even when a heavy article or a forklift truck is loaded into the supersized elevator.

Furthermore, it is possible to provide a supersized elevator capable of enabling a work vehicle such as a forklift truck or the like to be easily loaded into an elevator cage by a boarding platform.

Furthermore, it is possible to provide a supersized elevator capable of being easily transported to a necessary place using hoisting lugs provided in the top portion of the supersized elevator.

Furthermore, it is possible to provide a supersized elevator capable of minimizing a weight increase and a wind pressure influence by manufacturing all structures other than a machine room in an exposed form with no outer shell.

Furthermore, it is possible to provide a supersized elevator capable of being manufactured in an all-weather waterproof form so that the supersized elevator is not affected by rain or snow.

Furthermore, it is possible to provide a supersized elevator capable of being easily connected to a ship or an offshore plant by connection footboards provided at one side of the supersized elevator.

Furthermore, it is possible to provide a supersized elevator capable of essentially preventing occurrence of a safety accident which may otherwise be caused by the use of a lift and the use of stairs.

Furthermore, it is possible to provide a supersized elevator capable of eliminating a need to form a pit on a ground surface for the installation of the supersized elevator.

BRIEF DESCRIPTION OF THE DRAWINGS

The above and other objects and features of the present invention will become apparent from the following description of preferred embodiments given in conjunction with the accompanying drawings.

FIG. 1 is a perspective view schematically showing one example of a large-ship building facility of the related art.

FIG. 2 is a perspective view schematically illustrating a state in which a large ship is built using a supersized elevator according to the present invention.

FIG. 3 is a perspective view of an elevator structure according to the present invention.

FIG. 4 is a view of the elevator structure observed from line A-A in FIG. 3.

FIG. 5 is a view of the elevator structure observed from line B-B in FIG. 3.

FIG. 6 is a side view of a supersized elevator according to the present invention.

FIG. 7 is a plan view of the supersized elevator according to the present invention.

FIG. 8 is a view for explaining a rope emergency brake device of the supersized elevator according to the present invention.

FIG. 9 is a schematic configuration diagram of the rope emergency brake device of the supersized elevator according to the present invention.

FIG. 10 is a view illustrating a double crash preventing device of the supersized elevator according to the present invention.

FIG. 11 is a sectional view taken along line C-C in FIG. 10.

FIG. 12 is a sectional view taken along line D-D in FIG. 11.

FIG. 13 is a side view illustrating an elevator cage sagging preventing device of the supersized elevator according to the present invention.

FIG. 14 is a sectional view illustrating the elevator cage sagging preventing device of the supersized elevator according to the present invention.

FIG. 15 is a side view illustrating a boarding platform of the supersized elevator according to the present invention.

FIG. 16 is a plan view of the boarding platform of the supersized elevator according to the present invention.

FIG. 17 is a plan view illustrating a door opening/closing state in the supersized elevator according to the present invention.

FIG. 18 is a plan view illustrating the installation position of a wind shield module in the supersized elevator according to the present invention.

FIG. 19 is a schematic perspective view of the wind shield module in the supersized elevator according to the present invention.

FIG. 20 is a horizontal sectional view of the wind shield module in the supersized elevator according to the present invention.

FIG. 21 is a vertical sectional view of the wind shield module in the supersized elevator according to the present invention.

FIG. 22 is a perspective view of an elevating body in the supersized elevator according to the present invention.

DETAILED DESCRIPTION OF THE PREFERRED EMBODIMENTS

A preferred embodiment of a supersized elevator for use in building a large ship or an offshore plant will now be described with reference to FIGS. 2 to 22.

The supersized elevator according to one embodiment of the present invention includes an elevator cage 200 for accommodating passengers and heavy articles, a counterweight 230 for maintaining a weight balance with the elevator cage 200, a wire rope 220 for interconnecting the elevator cage 200 and the counterweight 230, and a winding machine 210 for winding the wire rope 220.

The elevator cage 200 and the counterweight 230 are installed in an elevator installation part 110 provided in a central region of an elevator structure 100. An emergency stair part 120 is installed at one side of both side of the elevator installation part 110.

That is to say, as illustrated in FIGS. 3 to 7, the elevator cage 200 and the counterweight 230 are provided at the center of the elevator structure 100, and the emergency stair part 120 is provided at one side of both side of the elevator structure 100.

As illustrated in FIG. 6, a machine room 150 is provided in the top portion of the elevator structure 100. The winding machine 210 for moving the elevator cage 200 up and down is installed in the machine room 150.

All structures other than the machine room 150 are provided in an externally exposed form with no outer shell. This makes it possible to minimize an increase in the weight of the structures and a wind pressure influence on the structures. Furthermore, all the structures exposed to the outside are subjected to a waterproof treatment and, therefore, can be used for all-weather purposes.

As illustrated in FIG. 3, a plurality of hoisting lugs 130 for use in lifting and transporting the elevator structure 100 as a whole is provided in the top portion of the elevator structure 100. Thus, as illustrated in FIG. 2, the elevator structure 100 as a whole may be lifted and easily transported to a necessary place by a gantry crane G or other supersized cranes provided in a dock of a shipyard.

The supersized elevator according to one embodiment of the present invention includes a wind shield module 800 vertically installed on one inner side surface of the elevator structure 100 and configured to prevent a tail cable 910 from being affected by a strong wind.

As illustrated in FIGS. 18 and 19, the tail cable 910 is a cable which interconnects a control board (not illustrated) installed in the machine room 150 and a junction box 900 provided in the top portion of the elevator cage 200. The tail cable 910 moves up and down together with the elevator cage 200 while maintaining a "U"-like shape.

As illustrated in FIG. 19, the tail cable 910 is formed in a flat shape so as to have a predetermined width D and a predetermined thickness t. Several tens of electric wires are provided within the tail cable 910 so as to transmit signals to an illumination device, a communication device, a variety of safety devices and a control device of the elevator cage 200.

As can be seen in FIG. 19, the wind shield module 800 includes a cover body 810 vertically installed on one side surface of the elevator structure 100, an elevating body 820 provided inside the cover body 810 so as to move up and down together with the tail cable 910, and a horizontal guide member 920 provided on the top surface of the elevator cage 200 so as to guide the tail cable 910 which moves up and down together with the elevating body 820. That is to say, the tail cable 910 and the elevating body 820 are configured to move up and down within the cover body 810 having a rectangular tube shape. By virtue of the above configuration, it is possible to prevent the tail cable 910 from being affected by a strong wind.

As illustrated in FIG. 22, the elevating body 820 includes a pair of vertical plates 821 provided in a central region of the elevating body 820 in a spaced-apart relationship with each other and a sheave 826 provided between the vertical plates 821 so that the tail cable 910 is wound around the sheave 826.

The elevating body 820 further includes an upper plate 822 horizontally provided in the top portions of the vertical plates 821, a plurality of upper wheels 824 provided at four corners of the upper plate 822, a lower plate 823 horizontally provided in the bottom portions of the vertical plates 821, and a plurality of lower wheels 825 provided at four corners of the lower plate 823.

It is preferred that four upper wheels 824 are provided at the four corners of the upper plate 822 and four lower wheels 825 are provided at the four corners of the lower plate 823. As illustrated in FIG. 20, the upper wheels 824 and the lower wheels 825 are preferably disposed on diagonal planes so as to move up and down along the four corners of the cover body 810. This configuration enables the elevating body 820 to stably move up and down within the cover body 810.

As illustrated in FIG. 22, two pairs of guide rollers 827 for guiding the tail cable 910 are provided on the opposite side surfaces of the upper plate 822 of the elevating body 820. Each pair of the guide rollers 827 is installed to leave a predetermined gap therebetween so that the tail cable 910 having a rectangular cross section can pass through the gap.

A pair of auxiliary rollers 828 is further provided at the longitudinal opposite ends of each pair of the guide rollers 827 so as to make contact with the opposite lateral surfaces of the tail cable 910.

As illustrated in FIG. 19, a vertical groove 811 for allowing the tail cable 910 to extend out of the cover body 810 and move up and down is formed on one side surface of the cover body 810. Thus, the tail cable 910 can move up and down in a state in which the tail cable 910 extends out of the cover body 810. As can be seen in FIG. 19, the vertical groove 811 has an opening width d which is smaller than the width D of the tail cable 910 and larger than the thickness t of the tail cable 910. By virtue of the above configuration, it is possible to prevent the tail cable 910 from being removed out of the cover body 810 during the up/down movement thereof.

As illustrated in FIG. 19, a horizontal guide member 920 for guiding the tail cable 910 from the vertical groove 811 toward the junction box 900 is provided in the top portion of the elevator cage 200. It is preferred that the horizontal guide member 920 is formed to have a width corresponding to the opening width d of the vertical groove 811.

By virtue of the above configuration, as illustrated in FIG. 19, the tail cable 910 extending from the sheave 826 is twisted substantially at a right angle when passing through the vertical groove 811 and is guided into the horizontal guide member 920 in the twisted state.

In the case of a conventional outdoor elevator, a tail cable is exposed to the outside. Thus, if a strong wind of about 20 to 30 m/sec is blown, it is almost impossible to operate the outdoor elevator.

However, in one embodiment of the present invention, the tail cable 910 is accommodated within the cover body 810 which is fixedly secured to the inner side surface of the elevator structure 100. Thus, if a strong wind of about 50 m/sec is blown, it is possible to prevent the tail cable 910 from being affected by the strong wind.

Referring to FIG. 5, connection footboards 140*a*, 140*b*, 140*c* and 140*d* for connecting the elevator structure 100 to a large ship S or an offshore plant are provided on one surface of the elevator structure 100.

The installation of the elevator structure 100 is completed by transporting the elevator structure 100 with a gantry crane G or a supersized crane, putting the elevator structure 100 on the ground and then connecting the connection footboards 140*a*, 140*b*, 140*c* and 140*d* to a large ship S or an offshore plant.

According to the present invention, there is no need to install a plurality of lifts L when building a supersized ship in a shipyard. Furthermore, it is not necessary to form a pit on the ground in order to install lifts L.

According to the supersized elevator of the present invention, it is possible to simultaneously and rapidly deploy a large number of workers, heavy articles and work vehicles to a high work site. This makes it possible to reduce a waste time and to significantly improve productivity.

As mentioned above, when building a supersized ship or an offshore plant, it is sometimes necessary to deploy hundreds or thousands of workers to a high work site. However, in the case of the lift L shown in FIG. 1, only several workers can get on the lift L. Thus, it is time-consuming to deploy a large number of workers. It is also time-consuming for workers to go down to the ground for lunch and to return to a high work site.

In order to solve the aforementioned problem, it is thinkable to install a plurality of lifts. In this case however, the cost for installing and removing the lifts increases. Moreover, if the number of workers reaches hundreds or thousands, the installation of the lifts cannot be a radical solution.

However, according to the supersized elevator of the present invention, it is possible to simultaneously and rapidly deploy a large number of workers, heavy articles and work vehicles to a high work site. This makes it possible to reduce a work preparation time and a waste time. Furthermore, this enables workers to start works immediately after lunch.

Moreover, in the case of the conventional lift transportation method shown in FIG. 1, it is impossible to rapidly evacuate workers to the ground when an emergency situation occurs in a high work site.

However, according to the supersized elevator of the present invention, it is possible to simultaneously and rapidly evacuate a large number of workers using the supersized elevator and the emergency stairs.

While four connection footboards 140*a*, 140*b*, 140*c* and 140*d* for connecting the elevator structure 100 to a large ship or an offshore plant are illustrated in FIGS. 3 to 6, the number and installation positions of the connection footboards is not limited thereto and may be appropriately changed depending on the work site situation. In addition, the size of the elevator structure 100 may be increased or reduced depending on the size of a large shape or an offshore plant to be built.

Next, a rope emergency brake device of the supersized elevator according to the present invention will be described with reference to FIGS. 8 and 9.

The rope emergency brake device 500 of the supersized elevator according to the present invention is designed to prevent crash, overspeed movement and reverse rotation of the elevator cage 200. The rope emergency brake device 500 includes a brake block module 510 composed of a movable brake block and a fixed brake block and configured to apply brake to a plurality of wire ropes 220, compression springs 512 and hydraulic cylinders 520 for operating the movable brake block of the brake block module 510, a frame 570 for supporting the brake block module 510, the compression springs 512 and the hydraulic cylinders 520, a hydraulic device 530 for supplying drive power to the hydraulic cylinders 520, a plurality of sensors 560 installed on one side surface of a wire rope sheave and configured to detect overspeed movement and reverse rotation of the wire rope sheave, and a controller 550 for releasing a fluid pressure applied to the hydraulic cylinders 520 and allowing expansion of the compression springs 512 when an abnormality is detected by the sensors 560.

It is preferred that three sensors 560 are installed to detect an abnormal rotation speed of the wire rope sheave. However, the present invention is not limited thereto.

The hydraulic device 530 includes a hydraulic tank 590, a hydraulic pump P, an electric motor M and a pressure releasing valve 580. The hydraulic device 530 operates the hydraulic cylinders 520 under the control of the controller 550.

The rope emergency brake device 500 further includes a rechargeable battery 540. The rechargeable battery 540 is used to operate the rope emergency brake device 500 even under a power outage condition.

The operation of the rope emergency brake device 500 will now be described in detail.

During a normal time, a fluid pressure is supplied to the upper chambers of the hydraulic cylinders 520, thereby keeping the compression springs 512 compressed. At this time, the pressure releasing valve 580 is kept closed and the hydraulic pump P is operated to supply a working fluid to the upper chambers of the hydraulic cylinders 520. A check valve 580*a* is provided to prevent the working fluid from flowing toward the hydraulic pump P.

In this state, the movable brake block and the fixed brake block of the brake block module 510 is kept spaced apart from each other. Thus, the wire ropes 220 are freely movable.

If the sensors 560 detect that the rotation speed of the wire rope sheave is 120% or more of a predetermined normal speed, the electric power supplied to a main electric motor (not illustrated) is cut off and a signal is transmitted to a main control board (not illustrated) to operate a main brake (not illustrated).

If the rotation speed of the wire rope sheave continues to increase, the controller 550 operates the pressure releasing valve 580 before the rotation speed of the wire rope sheave exceeds 140% of the predetermined normal speed. Then, the working fluid is drained from the upper chambers of the hydraulic cylinders 520 to the hydraulic tank 590, thereby removing a pressing force applied to the compression springs 512. Consequently, the movable brake block of the brake block module 510 is moved toward the fixed brake block of the brake block module 510 by the biasing forces of the compression springs 512, thereby applying brake to the wire ropes 220.

In the meantime, if the reverse rotation of the wire rope sheave is detected by the sensors 560, the controller 550 operates the pressure releasing valve 580 connected to the hydraulic cylinders 520. At the same time, the electric power supplied to the main electric motor (not illustrated) is cut off. In this case, the electric power for operating the pressure releasing valve 580 is supplied from a rechargeable battery 540. It is therefore possible to operate the pressure releasing valve 580 and to stop the elevator cage 200 even under a power outage condition.

Next, a double crash preventing device of the supersized elevator according to the present invention will be described with reference to FIGS. 10 to 12.

The double crash preventing device 600 of the supersized elevator according to the present invention is provided on a guide rail 208 which guides the side surface of the elevator cage 200. The double crash preventing device 600 is designed to prevent an uncontrollable accident such as crash or overspeed upward movement of the elevator cage 200.

As illustrated in FIGS. 11 and 12, the double crash preventing device 600 includes a safety block 610 configured to surround the guide rail 208 and provided with a plurality of slant surfaces 612 formed on one inner side surface thereof, a plurality of roller stoppers 640 provided on the slant surfaces 612, and a tripping rod 630 connected to the roller stoppers 640 and configured to pull the roller stoppers 640 upward to stop the elevator cage 200 when the elevator cage 200 moves down at an excessive speed.

It is preferred that a pair of safety blocks 610 is provided on the opposite side surfaces of the elevator cage 200 so as to apply brake at the opposite sides of the elevator cage 200.

As illustrated in FIG. 12, each of the slant surfaces 612 of the safety block 610 is formed so as to define a gap which grows smaller toward the upper side.

By virtue of the above configuration, when the elevator cage 200 is crashed, the tripping rod 630 is pulled upward so that the roller stoppers 640 are caught at the upper end of the gap of the safety block 610. That is to say, the crash of the elevator cage 200 is prevented by the wedging action of the roller stoppers 640 caught in the gap of the safety block 610.

The roller stoppers 640 are cylindrical members made of a highly rigid material. The surfaces of the roller stoppers 640 are preferably knurled in order to increase friction between the roller stoppers 640 and the safety block 610.

Since the roller stoppers 640 are provided in a plural number, it is possible to reliably prevent crash of the elevator cage 200. While three roller stoppers 640 are illustrated in FIG. 12, the number of the roller stoppers 640 may be increased or reduced depending on the weight of the elevator cage 200.

The operation of the double crash preventing device 600 will now be described in detail.

An overspeed governor machine (not illustrated) is provided in the machine room 150 disposed in the top portion of the elevator structure 100. The overspeed governor machine is connected to the tripping rod 630.

If the moving speed of the elevator cage 200 exceeds 120% of a predetermined normal speed, the electric power supplied to a main electric motor (not illustrated) is cut off and a signal is transmitted to a main control board (not illustrated) to operate a main brake (not illustrated).

If the moving speed of the elevator cage 200 continues to increase, the overspeed governor machine is operated to pull the tripping rod 630 before the moving speed of the elevator cage 200 exceeds 140% of the predetermined normal speed. Then, as illustrated in FIG. 12, the roller stoppers 640 connected to the tripping rod 630 are caught in the gap of the safety block 610. Thus, the elevator cage 200 is not moved down due to the wedging action of the roller stoppers 640.

If the elevator cage 200 is moved up by a drive motor after eliminating the cause of crash of the elevator cage 200, the roller stoppers 640 are released from the wedged state.

During the operation of the double crash preventing device 600, the elevator cage 200 cannot move downward due to the action of the roller stoppers 640 and the slant surfaces 612. However, the elevator cage 200 can move upward.

Next, a sagging preventing device of the elevator cage 200 will be described with reference to FIGS. 13 and 14.

When the elevator cage 200 is moved down to a lowermost position, the lower surface of the elevator cage 200 is spaced apart by a predetermined distance from a ground surface. A boarding platform 400 spaced apart by a predetermined distance from the ground surface is provided on one side surface of the elevator structure 100. A boarding door 300 is installed at one end of the boarding platform 400.

In order to keep the lower surface of the elevator cage 200 spaced apart by a predetermined distance from the ground surface, hydraulic cylinders 710 for supporting the elevator cage 200 are provided on the ground surface which faces toward the lower surface of the elevator cage 200.

If the elevator cage 200 is stopped in a stop position spaced apart by a predetermined distance (e.g., 1,200 mm) from the ground surface, the hydraulic cylinders 710 are moved up under the control of a control unit 730 so as to support the lower surface of the elevator cage 200.

By employing the above configuration, it is possible to easily load various kinds of components and work vehicles such as forklift trucks or the like into the elevator cage 200 and to rapidly transport them to a high work site.

While it is preferable to provide four hydraulic cylinders 710, the present invention is not limited thereto. The number of the hydraulic cylinders 710 may be increased or reduced depending on the size of the elevator cage 200.

In the case where the elevator cage 200 is stopped in a position other than the ground surface (see FIG. 6), the elevator cage 200 is held in position by allowing a support arm 720 provided in the lower portion of the elevator cage 200 to engage with a locking block 740 provided under each of the connection footboards 140*b*, 140*c* and 140*d*.

That is to say, as illustrated in FIG. 14, a locking block 740 for supporting the lower portion of the elevator cage 200 stopped in a specific position is provided under each of the connection footboards 140*b*, 140*c* and 140*d*. The locking block 740 is provided between a seal 320 of the boarding door 300 and a structural frame. The locking block 740 includes a seat portion on which a support arm 720 can be seated.

The support arm 720 is connected to the lower surface of the elevator cage 200 by an arm fixing bracket 280 and is rotatable at a predetermined angle. The support arm 720 is sized and shaped so as not to interfere with the cage door seal 260 and the locking block 740. It is preferred that two support arms 720 and two locking blocks 740 are installed at the left and right sides. However, the present invention is not limited thereto.

If the elevator cage 200 arrives at a specific story, the support arm 720 is extended by a hydraulic cylinder 710 so that the support arm 720 is seated on the locking block 740. It is therefore possible to prevent the elevator cage 200 from being sagged down even when heavy articles such as a forklift truck and the like are loaded into the elevator cage 200.

If the cage door 240 and the boarding door 300 are closed after loading or unloading workers or work vehicles into or out of the elevator cage 200, the hydraulic cylinder 710 is operated to retract the support arm 720 to the original position.

It is preferred that the hydraulic cylinder 710 for extending and retracting the support arm 720 is operated in synchronism with the opening/closing of the cage door 240 and the boarding door 300 under the control of a main control board. This makes it possible to prevent the support arm 720 from hindering the up/down movement of the elevator cage 200.

Next, the boarding platform 400 provided in the lower portion of the elevator structure 100 will be described with reference to FIGS. 15 and 16.

In the supersized elevator according to the present invention, the elevator cage 200 is stopped in the position spaced apart by a predetermined distance from the ground surface (see FIG. 6). Thus, the boarding platform 400 is provided at one side of the lower portion of the elevator structure 100.

As illustrated in FIGS. 15 and 16, the boarding platform 400 includes an upper slant plate 420 and a lower slant plate 410, both of which are provided in a central region, and a pair of stairs 440 which is provided at the opposite lateral sides of the upper slant plate 420.

The upper slant plate 420 and the lower slant plate 410 are used to load a work vehicle such as a forklift truck or the like into the elevator cage 200. Workers may get on the elevator cage 200 via the stairs 440 provided at the opposite lateral sides of the upper slant plate 420.

As illustrated in FIG. 16, hydraulic cylinders 430 for folding and unfolding the lower slant plate 410 are installed at the opposite lateral sides of the upper slant plate 420.

In the case where the elevator structure 100 is not transported by a gantry crane or in the case where the elevator cage 200 is not operated, the lower slant plate 410 may be folded onto the upper slant plate 420 by the hydraulic cylinders 430. By doing so, it is possible to increase the use area of a dock and to prevent the lower slant plate 410 from hindering the passage of workers or work vehicles.

Next, the cage door 240 and the boarding door 300 will be described with reference to FIG. 17.

The supersized elevator according to the present invention is about 10 times as large as a typical elevator and, therefore, is provided with a plurality of doors.

In FIG. 17, there are illustrated six cage doors 240 and six boarding doors 300. The number of the cage doors 240 and the number of the boarding doors 300 may be increased or reduced.

The cage doors 240 and the boarding doors 300 may be opened either partially or fully. It is time-consuming to fully open the cage doors 240 and the boarding doors 300. Thus, in the case where only workers get on the elevator cage 200, it is preferred that the cage doors 240 and the boarding doors 300 are not fully opened but partially opened as illustrated in FIG. 7. For this purpose, a full open button and a partial open button (not illustrated) are provided in the operation panel of the elevator cage 200. Alternatively or additionally, a sensor for detecting workers or work vehicles may be installed in the boarding area. If only workers are detected by the sensor, the cage doors 240 and the boarding doors 300 may be automatically opened, e.g., one half.

By virtue of the above configuration, it is possible to shorten the opening/closing time of the cage doors 240 and the boarding doors 300. It is also possible to reduce the amount of an external cold or hot air introduced into the elevator cage 200. This helps maintain the internal temperature of the elevator cage 200 at a suitable temperature.

According to the supersized elevator of the present invention, unlike a conventional lift, it is possible to simultaneously and rapidly transport a large number of workers, heavy articles and work vehicles to a high work site. This helps improve productivity. Particularly, it is possible to significantly reduce the time required for workers to move between the high work side and the ground.

Furthermore, it is possible to simultaneously and rapidly evacuate a large number of workers to the ground in the case of occurrence of a safety accident such as a fire or an explosion accident in a building site of a large ship or an offshore plant.

In a conventional method of lifting various kinds of work vehicles using a gantry crane, a great deal of time is required in fixing wire ropes and preparing a loft work. Furthermore, there is a high risk of accidents when lifting heavy articles.

However, according to the present invention, it is possible to provide a supersized elevator capable of rapidly and safely transporting work vehicles such as a forklift truck and the like a high work site.

Furthermore, it is possible to provide a supersized elevator capable of being manufactured as a consolidated self-standing structure together with emergency stairs, a machine room and other structures and capable of being easily lifted, moved and provided for continuous use.

Furthermore, it is possible to provide a supersized elevator capable of minimizing a weight increase and a wind pressure influence by manufacturing all structures other than a machine room in an exposed form with no outer shell.

Furthermore, it is possible to provide a supersized elevator capable of ensuring that a tail cable moving up and down together with an elevator cage is hardly affected by a strong wind of 30 to 50 m/sec.

Furthermore, it is possible to provide a supersized elevator capable of being manufactured in an all-weather waterproof form so that the supersized elevator is not affected by rain or snow.

Furthermore, it is possible to provide a supersized elevator capable of eliminating a need to form a pit on a ground surface for the installation of the supersized elevator. The supersized elevator may be installed in any flat ground surface. The supersized elevator may be safely used by supplying electric power after the supersized elevator is placed on a ground surface.

While one preferred embodiment of the present invention has been described above, the present invention is not limited thereto. It is to be understood that various changes and modifications may be made without departing from the scope of the invention defined in the claims.

What is claimed is:

1. A supersized elevator for use in building a large ship or an offshore plant, comprising:

an elevator structure;

an elevator cage configured to accommodate passengers and heavy articles;

a counterweight configured to maintain a weight balance with the elevator cage;

a wire rope configured to interconnect the elevator cage and the counterweight; and a winding machine configured to wind the wire rope, wherein the elevator cage and the counterweight are installed in an elevator installation part provided in a central region of the elevator structure, an emergency stair part is provided at least one side of the elevator installation part, a plurality of hoisting lugs is provided in a top portion of the elevator structure so that the elevator structure as a whole can be hoisted, transported and placed on a flat ground surface, a wind shield module configured to prevent a tail cable from being affected by a strong wind is vertically installed on one inner side surface of the elevator structure, and the wind shield module includes a cover body vertically installed on one side surface of the elevator structure, an elevating body provided inside the cover body so as to move up and down together with the tail cable, and a horizontal guide member provided on a top surface of the elevator cage so as to guide the tail cable which moves up and down together with the elevating body.

2. The supersized elevator of claim 1, wherein the elevating body includes a pair of vertical plates provided in a central region of the elevating body in a spaced-apart relationship with each other, a sheave provided between the vertical plates so that the tail cable is wound around the sheave, an upper plate horizontally provided in top portions of the vertical plates, a plurality of upper wheels provided at corners of the upper plate, a lower plate horizontally provided in bottom portions of the vertical plates, and a plurality of lower wheels provided at corners of the lower plate.

3. The supersized elevator of claim 2, wherein two pairs of guide rollers configured to guide the tail cable are provided on opposite side surfaces of the upper plate of the elevating body, and a pair of auxiliary rollers is further provided at longitudinal opposite ends of each pair of the guide rollers.

4. The supersized elevator of claim 1, wherein a vertical groove for allowing the tail cable to extend out of the cover body and to move up and down is formed on one side surface of the cover body, and the vertical groove has an opening width (d) which is smaller than the width (D) of the tail cable and larger than the thickness (t) of the tail cable.

5. The supersized elevator of claim 4, wherein a horizontal guide member for guiding the tail cable from the vertical groove toward a junction box is provided in a top portion of the elevator cage.

6. The supersized elevator of claim 1, further comprising:

a rope emergency brake device configured to prevent crash, over speed movement and reverse rotation of the elevator cage, wherein the rope emergency brake device includes a brake block module composed of a movable brake block and a fixed brake block and configured to apply brake to a plurality of wire ropes, compression springs and hydraulic cylinders configured to operate the movable brake block of the brake block module, a frame configured to support the brake block module, the compression springs and the hydraulic cylinders, a hydraulic device configured to supply drive power to the hydraulic cylinders, a plurality of sensors installed on one side surface of a wire rope sheave and configured to detect over speed movement and reverse rotation of the wire rope sheave, a pressure releasing valve configured to, when operated, release a pressure applied to the hydraulic cylinders, and a controller configured to operate the pressure releasing valve when the over speed movement or the reverse rotation of the wire rope sheave is detected by the sensors.

7. The supersized elevator of claim 1, wherein a double crash preventing device to prevent crash of the elevator cage is provided on a guide rail which guides a side surface of the elevator cage, and wherein the double crash preventing device includes a safety block configured to surround the guide rail and provided with a plurality of slant surfaces formed on one inner side surface so that each of the slant surfaces is formed to define a gap which grows smaller toward an upper side, a plurality of roller stoppers provided on the slant surfaces, and a tripping rod connected to the roller stoppers and configured to pull the roller stoppers upward to stop the elevator cage when the elevator cage moves down at an excessive speed.

8. The supersized elevator of claim 1, further comprising:

a boarding platform provided on one side surface of the elevator structure and spaced apart by a predetermined distance from a ground surface;

a hydraulic cylinders configured to prevent sagging of the elevator cage moved to a lowermost position, the hydraulic cylinders provided on a ground surface which faces toward a lower surface of the elevator cage; and a boarding door installed at one end of the boarding platform.

9. The supersized elevator of claim 1, wherein a locking block configured to support a lower portion of the elevator cage stopped in a specific position is provided under each of the connection footboards, and a support arm configured to engage with the locking block and a hydraulic cylinder configured to rotate the support arm at a predetermined angle are provided under the elevator cage.

* * * * *